United States Patent [19]

Epsztein et al.

[11] 4,286,191

[45] Aug. 25, 1981

[54] DELAY LINE WITH COUPLED CAVITIES

[75] Inventors: Bernard Epsztein; George Fleury, both of Paris, France

[73] Assignee: Thomson-CSF, Paris, France

[21] Appl. No.: 44,340

[22] Filed: May 30, 1979

[30] Foreign Application Priority Data

Jun. 2, 1978 [FR] France ..... 78 16552

[51] Int. Cl.[3] ..... H01P 9/00; H01J 23/24

[52] U.S. Cl. ..... 315/3.6; 315/3.5; 333/157

[58] Field of Search ..... 315/3.5, 3.6, 5, 5.29, 315/39, 39.3; 333/156–157, 248; 330/42, 43

[56] References Cited

U.S. PATENT DOCUMENTS 2,966,610 12/1960 Schmidt et al. ..... 315/3.5

3,153,767 10/1964 Kyhl ..... 333/157

*Primary Examiner*—Marvin L. Nussbaum

*Attorney, Agent, or Firm*—Roland Plottel

[57] ABSTRACT

The areas of the walls 1 separating two adjacent cavities that are located on the periphery of the opening 3 for allowing through the electron beam, and whose thermal resistance is greatest, are those comprised between this opening 3 and a cavity coupling opening 2. Owing to the opening 3 for allowing through the electron beam (elliptical, centered on the axis of the line 00', with the large axis of the ellipse merging with the axis of symmetry AA' of the coupling openings 2 intersecting the axis 00'), these areas are the furthest away from the axis of the line 00' along which the electron beam is propagated. The invention is applied to microwave tubes and in particular to travelling-wave tubes.

3 Claims, 3 Drawing Figures

DELAY LINE WITH COUPLED CAVITIES

Figure 1:
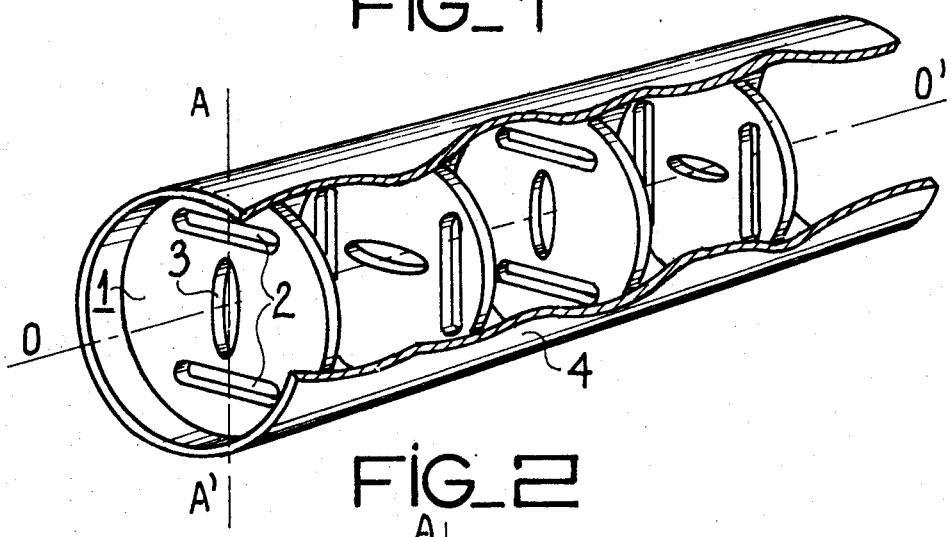

The present invention relates to a delay line with coupled cavities used in a microwave tube.

Delay lines with coupled cavities are more particularly used in travelling-wave tubes, where they ensure the interaction between a beam of electrons travelling along the axis of the line and an electromagnetic wave travelling along the line; when conditions required for synchronism of the wave and the beam are met, the electrons yield up energy to the electromagnetic wave.

Delay line with coupled cavities are constituted by a series of resonant cavities separated from another by walls pierced by at least one opening for coupling between cavities and by an opening to allow through the electron beam focussed along the axis of the line.

The thermal agitation at the cathode emitting the electron beam and irregularities in the focussing of the beam along the axis of the line cause the areas of the walls separating two adjacent cavities which are located on the periphery of the opening designed to allow through the electron beam to be subjected to bombardment by electrons, which raises their temperature; said temperature rise is all the greater the higher the thermal resistance of said areas.

The opening designed to allow through the electron beam is generally circular and centred on the axis of the line and the areas of the walls separating two adjacent cavities, which are located on the periphery of said opening, and whose thermal resistance is greatest, are those comprised between said opening and an opening for coupling cavities. The temperature rise in these areas limits the efficiency of the microwave tubes (of given dimensions) comprising a delay line with coupled cavities.

A considerable increase in the diameter of the opening allowing through the electron beam and centered on the axis of the line would enable almost all of the electrons in the beam to pass through and the temperature rise in the areas of high thermal resistance would thus be reduced.

The drawback of this structure is that it reduces the H.F. electric field in the electron beam. When the electron beam is focussed along the axis of the line using permanent magnets with an alternating magnetic field, the walls separating two adjacent cavities are of a magnetic material and this increase in the diameter of the opening allowing through the electron beam also has the drawback, in this case, of reducing the magnetic field for focussing the beam along the axis of the line.

By placing the cavity coupling opening further away from the axis of the line on which is centered the opening to allow through the electron beam, it would be possible to reduce to a certain extent the thermal resistance of the areas of the walls separating two cavities located between said two openings.

The disadvantage of this structure is, in the case of focussing by permanent magnets with alternating magnetic fields, an increase in the magnetic leakage flux in the walls, which are of magnetic material, separating two adjacent cavities, and this increase could go so far as to saturate the magnetic material; now, focussing using permanent magnets with alternating magnetic fields is very advantageous as regards weight, electricity consumption and reduction of the leakage of magnetic fields in particular.

The present invention makes it possible to reduce the temperature rise in the areas of the walls separating two cavities which are located on the periphery of the opening allowing through the electron beam and whose thermal resistance is greatest, while, at the same time, avoiding the drawbacks of reduction in the electric and magnetic fields, increase in magnetic leakage flux, associated with the structures previously contemplated. The efficiency of the microwave tubes (of given dimensions) comprising a coupled cavity type delay line, according to the invention, can thus be increased considerably.

According to the invention, the areas of the walls separating two adjacent cavities, which are located on the periphery of the opening to allow through the electron beam, and whose thermal resistance is greatest, are the furthest from the axis of the line along which the electron beam is propagated. When the walls separating two adjacent cavities are pierced by two coupling openings, symmetrical in relation to the axis of the line, the opening to allow through the electron beam is substantially elliptical, with the centre of the ellipse located on the axis of the line and the large axis of the ellipse merging with the axis of symmetry of the coupling openings intersecting the axis of the line. When the walls separating two adjacent cavities are pierced by a single coupling opening, the opening allowing through the electron beam is circular, with the centre of this circle located on the axis of symmetry of the coupling opening intersecting the axis of the line and somewhat offset in relation to the axis of the line towards the location of the coupling opening.

Figure 2:
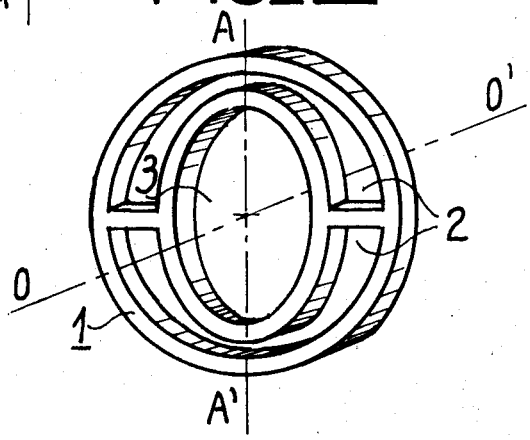
Figure 3:
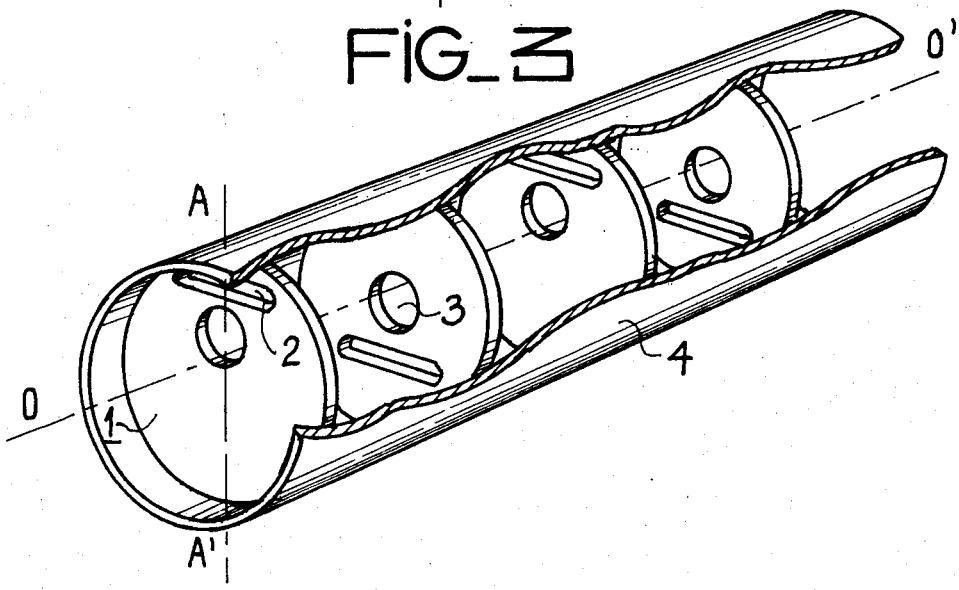

Other objects, features and results of the invention will become apparent from the following description given by way of a non-limitative example and illustrated by the attached figures which represent;

FIGS. 1 and 3, perspective views of a delay line with cavities respectively coupled by two and by a single coupling opening according to the invention;

FIG. 2, a perspective view of the wall separating two adjacent cavities of a so-called "double $\pi$" delay line according to the invention;

In the different figures, the same reference numbers designate the same elements and, for the sake of clarity, the dimensions and proportions of the different elements have not benn observed.

FIG. 1 shows a perspective view of a delay line with cavities coupled by two coupling openings according to the invention.

The delay line shown in FIG. 1 comprises discs, aligned parallel to one another along the same axis constituting axis 00' of the line and forming the wall common to two adjacent cavities, 1. It also comprises a cylindrical wall, 4, completely delimiting the cavities. These discs are pierced by two cavity coupling openings, 2, symmetrical in relation to the axis of the line 00'. The opening, 3, to allow through the electron beam is substantially elliptical, with the centre of the ellipse located on the axis of the line 00' and the large axis of the ellipse merging with the axis of symmetry, AA' of the coupling openings 2 intersecting the axis of the line 00'.

The areas of the discs, located on the periphery of the opening allowing through the electron beam, and whose thermal resistance is greatest, are located between the openings 2 and 3. Owing to the opening, 3, allowing through the electron beam (elliptical, centred on 00', with the large axis of the ellipse merging with AA'), these areas are the furthest away from the axis of the line 00', along which the electron beam is propagated. Electron bombardment of these areas is thus small since, in their direction, almost all of the electron beam is collected by opening 3 allowing through the electron beam. The temperature rise in these areas is thus smaller than when the opening to allow through the electron beam is a circle centred on the axis of the line 00', without it being necessary to increase its surface or to move the cavity coupling openings 2 further away from the axis of line 00'.

On the line shown in FIG. 1, the cavity coupling openings 3 are offset by 90° from one wall 1 separating two cavities to the next, which is generally the case when the interaction between the beam and the electromagnetic wave takes place on the first harmonic of the electromagnetic wave.

The large axis of the ellipse is thus offset by 90° degrees from one wall 1 to the next.

FIG. 2 shows a perspective view of the wall 1 separating two adjacent cavities of a so-called "double $\pi$" delay line according to the invention.

A double $\pi$ line is a delay line with coupled cavities whose walls separating two adjacent cavities are pierced by an opening to allow through the electron beam and by two cavity coupling openings symmetrical in relation to the axis of the line along which the electron beam is propagated, these openings taking up almost all the surface area of the walls. The opening to allow through the electron beam is generally circular and centred on the axis of the line.

In the double line according to the invention, shown in FIG. 2, the opening 3 allowing through the electron beam is substantially elliptical, with the centre of the ellipse located on the axis of the line and the large axis of the ellipse merging with the axis of symmetry AA' of the coupling openings 2 intersecting line 00'.

FIG. 3 is a perspective view of a delay line with cavities coupled by a single coupling opening according to the invention.

The delay line shown in FIG. 3 differs from that shown in FIG. 1 by its single cavity coupling opening 2 and by its opening, 3, to allow through the electron beam. The electron beam ipening 3, according to the invention is circular, with the centre of this circle located on the axis of symmetry AA' of the coupling opening 2 intersecting the axis of the line 00' and somewhat offset in relation to the axis of line 00' towards coupling opening 2.

On the line shown in FIG. 3, the cavity coupling opening is offset by 180° from one wall 1 separating two adjacent cavities to the next. The centre of the electron beam opening 3 is located on the axis AA'; it is therefore offset in relation to axis 00' in opposite directions from one wall 1 to the next.

What we claim is:

1. A delay line with coupled cavities constituted by a series of resonant cavities, separated from one another by walls pierced by two cavity coupling openings, symmetrical in relation to the axis of the line, and by an opening to allow through an electron beam, which in operation of the line is focussed along the axis of the line, wherein the opening to allow through the electron beam is substantially elliptical, with the center of the ellipse located on the axis of the line and the large axis of the ellipse aligned with the axis of symmetry of the cavity coupling openings.

2. A "double $\pi$" delay line constituted by a series of cavities, separated from one another by walls pierced by two cavity coupling openings, symmetrical in relation to the axis of the line, and by an opening to allow through an electron beam, which during operation of the line is focussed along the axis of the line, these openings taking up almost all the surface area of the walls, wherein the opening to allow through the electron beam is substantially elliptical, with the center of the ellipse located on the axis of the line, and the large axis of the ellipse aligned with the axis of symmetry of the cavity coupling openings.

3. A delay line with coupled cavities constituted by a series of resonant cavities, separated from one another by walls pierced by a single cavity coupling opening, and by a circular opening to allow through an electron beam, which during operation of the line is focussed along the axis of the line, wherein the center of the circular opening to allow through the electron beam is located on the axis of symmetry (FIG. 3, AA') of the cavity coupling openings intersecting the axis of the line (00') and somewhat offset in relation to the axis of the line (00') towards the location of the coupling opening.

* * * * *